US007475670B2

(12) United States Patent
Sato et al.

(10) Patent No.: US 7,475,670 B2
(45) Date of Patent: Jan. 13, 2009

(54) VALVE OPERATING MECHANISM

(75) Inventors: Tadayoshi Sato, Aichi-ken (JP); Toshiyuki Kawabe, Toyohashi (JP); Hiromitsu Ishihara, Okazaki (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/878,900

(22) Filed: Jul. 27, 2007

(65) Prior Publication Data

US 2008/0029056 A1 Feb. 7, 2008

(30) Foreign Application Priority Data

Aug. 3, 2006 (JP) ..... 2006-212386

(51) Int. Cl.
*F02D 11/06* (2006.01)
*F02D 11/10* (2006.01)

(52) U.S. Cl. ..... 123/396; 123/400

(58) Field of Classification Search ..... 123/376, 123/396, 399, 400, 337, 319
See application file for complete search history.

(56) References Cited

U.S. PATENT DOCUMENTS 3,596,644 A * 8/1971 Hutchins ..... 123/406.71
4,210,110 A * 7/1980 Krebaum et al. ..... 123/396
4,555,762 A * 11/1985 Ohgami et al. ..... 701/112
4,947,815 A * 8/1990 Peter ..... 123/399
5,065,719 A * 11/1991 Panten et al. ..... 123/389
RE34,574 E * 4/1994 Imoehl ..... 123/399
5,704,334 A * 1/1998 Kato ..... 123/336
5,762,044 A * 6/1998 Hollister et al. ..... 123/400
5,829,409 A * 11/1998 Saito et al. ..... 123/396
5,957,108 A * 9/1999 Kato ..... 123/336

FOREIGN PATENT DOCUMENTS

JP 5-69474 2/1992

* cited by examiner

*Primary Examiner*—Mamoud Gimie
(74) *Attorney, Agent, or Firm*—Reed Smith LLP; Stanley P. Fisher, Esq.; Juan Carlos A. Marquez, Esq.

(57) ABSTRACT

A valve operating mechanism includes a valve body provided at an air passage of an internal combustion engine, an actuator causing the valve body to rotate so as to adjust a cross-sectional area of the air passage, a shaft body supporting the valve body, a link member connected to the shaft body and integrally rotating with the valve body, an actuator rod rotatably connected to the link member and transmitting a driving force of the actuator to the link member, and a biasing member arranged between the link member and the actuator rod and biasing the link member and the actuator rod so as to contact each other.

10 Claims, 4 Drawing Sheets

VALVE OPERATING MECHANISM

CROSS REFERENCE TO RELATED APPLICATIONS

This application is based on and claims priority under 35 U.S.C. § 119 to Japanese Patent Application No. 2006-212386, filed on Aug. 3, 2006, the entire content of which is incorporated herein by reference.

FIELD OF THE INVENTION

This invention generally relates to a valve operating mechanism. More particularly, this invention pertains to a valve operating mechanism for changing and adjusting a cross-sectional area of an air passage of an internal combustion engine by rotating a valve body provided at the air passage by means of an actuator.

BACKGROUND

A known valve operating mechanism is used, for example, as an air intake valve operating mechanism in which the intake valve is formed at an intake manifold of a vehicle. The air intake valve is supported at an intake passage so as to be able to open and close. The air intake valve changes an air intake flow rate by opening and closing to thereby improve engine combustion.

Such air intake valve operating mechanism is disclosed in JP05-069474U. The operating mechanism disclosed includes a valve body (valve) provided at an air intake pipe, a shaft body supporting the valve body so as to be integrally rotatable therewith, and a link member. The link member is connected to the shaft body so as to be integrally rotatable therewith. The link member is also rotatably connected to an actuator rod that performs a protruding operation and a returning operation relative to an actuator. As a result, the protruding operation and the returning operation of the actuator rod are transmitted as a rotational operation to the valve body so that the valve body opens and closes. The valve operating mechanism is required to appropriately adjust an opening degree of the valve body in response to a condition of the engine revolutions, and the like. Then, in order to prevent looseness at a connecting portion between the actuator rod and the link member, a torsion spring is provided. One end of the torsion spring engages with the link member while the other end of the torsion spring engages with an actuator bracket through which the actuator is fixed to an outer peripheral portion of an intake manifold. The link member and the actuator rod are biased by the torsion spring so as to contact each other to thereby prevent looseness at the connecting portion between the actuator rod and the link member.

According to the valve operating mechanism disclosed in JP05-069474U, however, the torsion spring is disposed between the link member that is movable and the actuator bracket that is fixed. Thus, at the time of operation of the actuator so as to operate the link member via the actuator rod, the actuator needs to operate against a biasing force of the torsion spring. As a result, a large-sized actuator is required to achieve a desired responsiveness for opening and closing of the valve.

Thus, a need exists for a valve operating mechanism which is not susceptible to the drawback mentioned above.

SUMMARY OF THE INVENTION

According to an aspect of the present invention, a valve operating mechanism includes a valve body provided at an air passage of an internal combustion engine, an actuator causing the valve body to rotate so as to adjust a cross-sectional area of the air passage, a shaft body supporting the valve body, a link member connected to the shaft body and integrally rotating with the valve body, an actuator rod rotatably connected to the link member and transmitting a driving force of the actuator to the link member, and a biasing member arranged between the link member and the actuator rod and biasing the link member and the actuator rod so as to contact each other.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

An embodiment of the present invention will be explained with reference to the attached drawings. A valve operating mechanism according to the present embodiment is used, for example, in a valve opening and closing mechanism for opening and closing a variable intake valve of an intake air control system that adjusts a flow rate of air supplied to an internal combustion engine.

Figure 1:
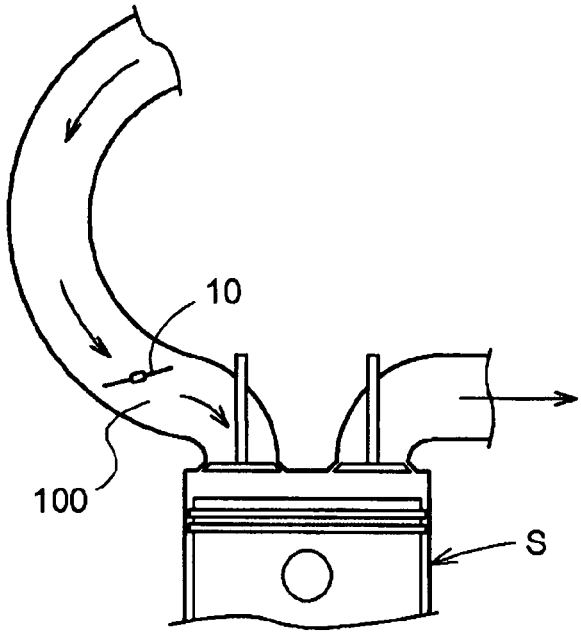
FIG. 1 is a view illustrating an example of an intake air control system in which a valve operating mechanism according to an embodiment of the present invention is employed.
Figure 2:
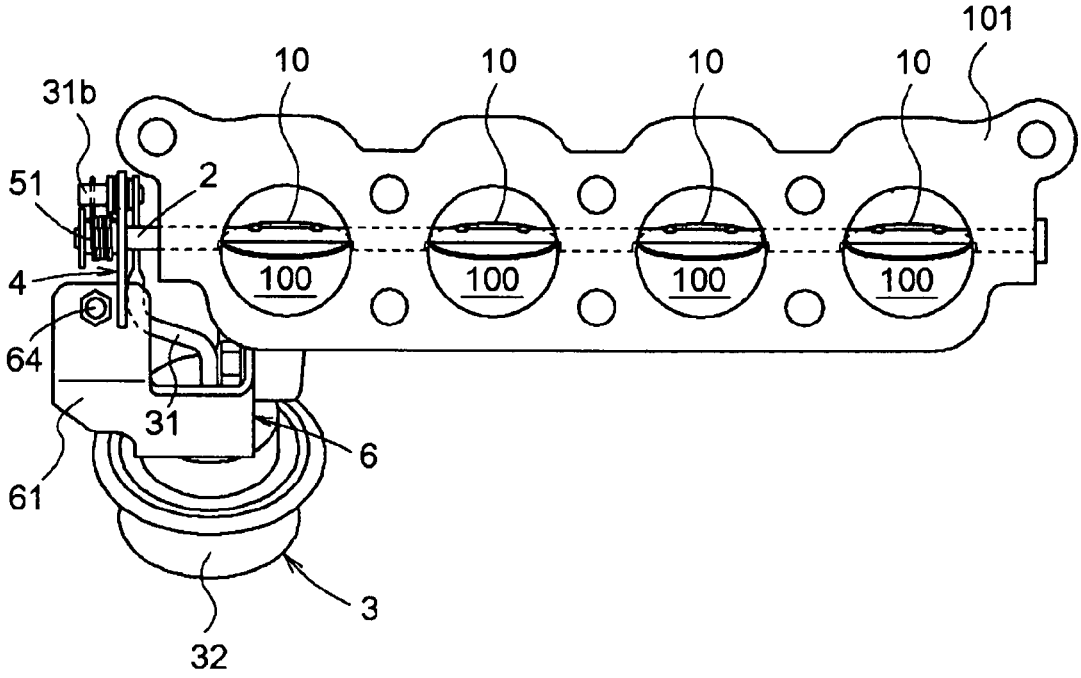
FIG. 2 is a view illustrating an example of a valve opening and closing mechanism according to the embodiment of the present invention.

FIGS. 1 and 2 each illustrate a valve operating mechanism according to the present embodiment employed in an intake air control system for a valve opening and closing mechanism that adjusts a flow rate of air supplied to a four-cylinder straight engine. As illustrated in FIGS. 1 and 2, the intake air control system includes an intake manifold having multiple air intake pipes 100 (for example, four, according to the present embodiment). Each end of the air intake pipe 100 is connected to each cylinder S. In addition, variable intake valves 10 (valve body) are provided in the respective air intake pipes 100, being close to the cylinders S. The intake air control system aims to improve engine combustion by varying a cross-sectional area of air passing through each air intake pipe 100.

As illustrated in FIG. 2, the aforementioned valve opening and closing mechanism includes the variable intake valves 10 of a butterfly type rotatably provided in the respective air intake pipes 100, a shaft body 2 for bringing the variable intake valves 10 to rotate, and an actuator 3 for driving the shaft body 2.

The shaft body 2 is arranged so as to be perpendicular to four air intake pipes 100 of the intake manifold. The shaft body 2 is inserted into a bearing bore formed in the vicinity of a flange portion 101 of the intake manifold and is rotatably supported. The variable intake valves 10 are attached by means of screws, for example, to respective portions of the shaft body 2 facing and corresponding to the air intake pipes 100, respectively.

Figure 3:
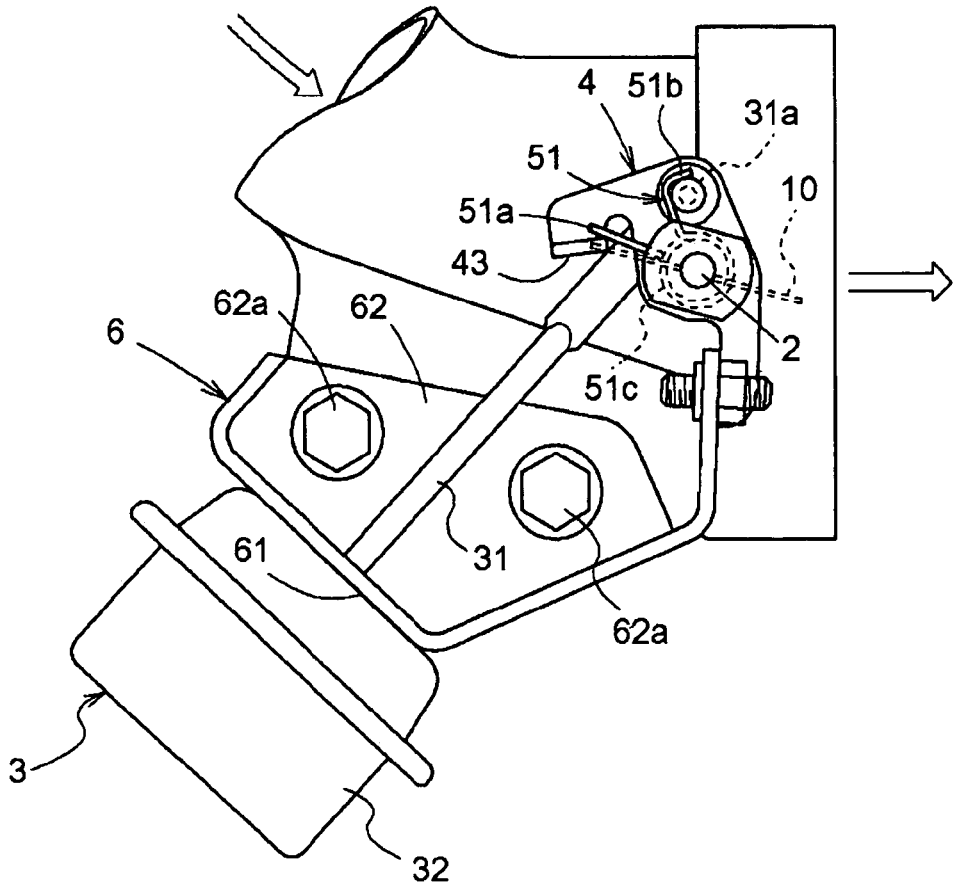
FIG. 3 is a side view illustrating a main portion of the valve operating mechanism.

As illustrated in FIG. 3, the actuator 3 is supported at an outer peripheral portion of the intake manifold via a bracket 6. The bracket 6 includes a first wall portion 61 onto which the actuator 3 is assembled and a second wall portion 62 connected to the first wall portion 61 in a substantially upright manner. The second wall portion 62 is assembled onto a fitting portion formed at the outer peripheral portion of the intake manifold by means of a bolt 62*a*, for example, so that the actuator 3 is supported at the outer peripheral portion of the intake manifold.

The actuator 3 of a diaphragm type, for example, includes an actuator main body 32 and an actuator rod 31 that protrudes from or returns to the actuator main body 32. An inside of the actuator main body 32 is divided into an atmospheric pressure chamber (not shown) and a negative pressure chamber (not shown) by means of a diaphragm (not shown). The diaphragm is biased towards the atmospheric pressure chamber. An end portion of the actuator rod 31 facing the actuator main body 32 is connected to the diaphragm. The actuator rod 31 is inserted into the actuator main body 32 (i.e., returning operation) upon application of negative pressure to the negative pressure chamber while protruding from the actuator main body 32 (i.e., protruding operation) upon cancellation of application of negative pressure to the negative pressure chamber. A pivot shaft 31 a is provided at an end portion of the actuator rod 31 so as to project in a direction in parallel with the shaft body 2.

Figure 4:
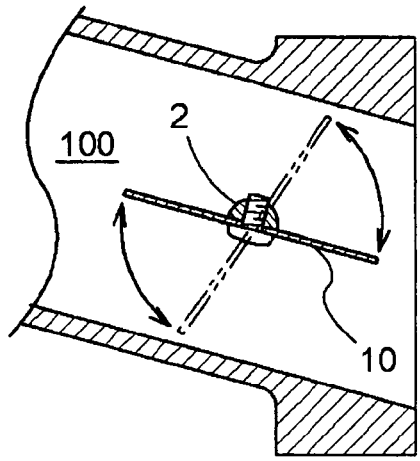
FIG. 4 is a view illustrating an opening and closing operation of a valve body.
Figure 5A:
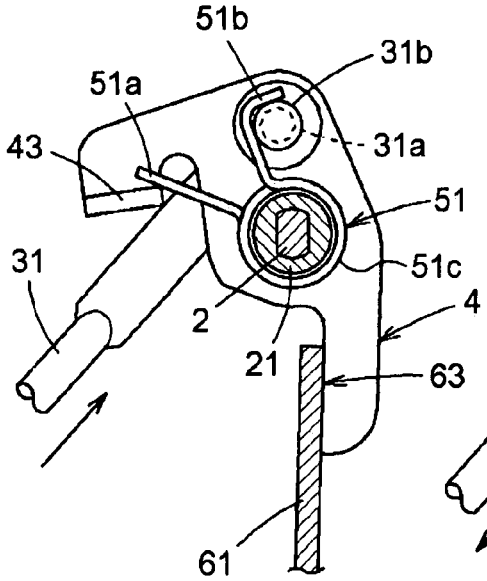
FIGS. 5A and 5B are views each illustrating an operation of the valve operating mechanism.
Figure 5B:
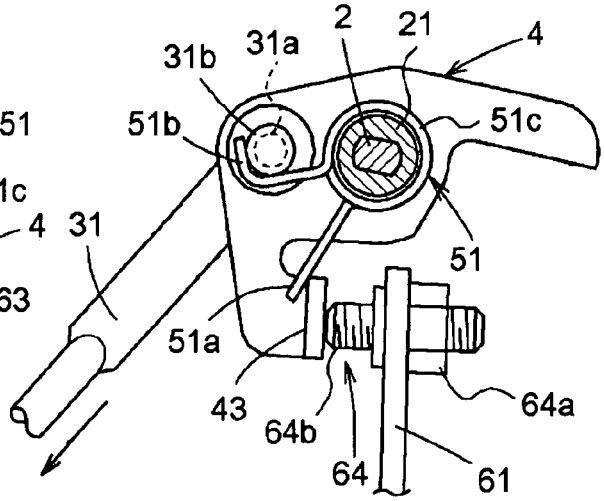
Figure 6:
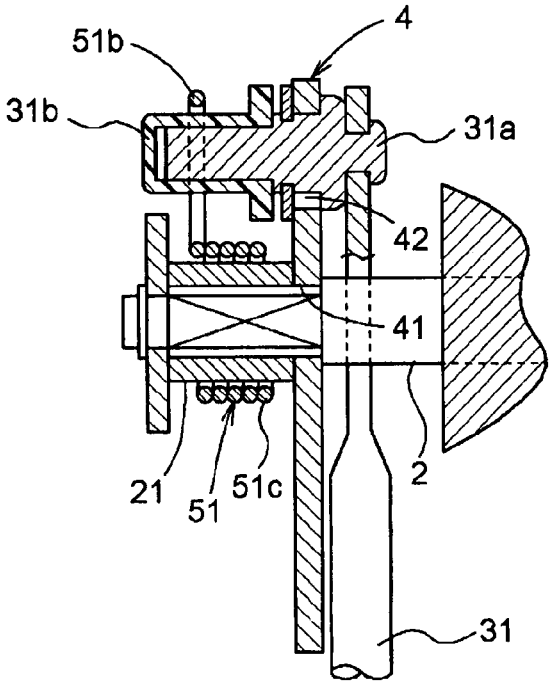
FIG. 6 is a cross-sectional view illustrating a main portion of the valve operating mechanism.

As illustrated in FIGS. 2 and 3, one end of the shaft body 2 projects from an end portion of the intake manifold. This projecting portion and the actuator rod 31 are connected to each other by means of a link member 4. That is, as illustrated in FIG. 6, a bore 41 is formed at the link member 4. Then, the projecting portion of the shaft body 2 is integrally rotatably inserted into the bore 41 so that the link member 4 and the shaft body 2 are integrally rotatable to each other. In addition, a bore 42 is formed at the link member 4. Then, the pivot shaft 31*a* provided at the end portion of the actuator rod 31 is inserted into the bore 42 so that the actuator rod 31 and the link member 4 are relatively rotatable to each other. Accordingly, as illustrated in FIGS. 4, 5A, and 5B, the protruding operation and the returning operation of the actuator rod 31 are transmitted as a rotational operation to the shaft body 2 via the link member 4.

As illustrated in FIG. 3, a portion of the link member 4 is bent to form an engagement portion 43 with which a torsion spring 51 (biasing member) engages. In addition, as illustrated in FIG. 6, a resin-made bush 31*b* (protection member) is provided at an outside of a projecting portion of the pivot shaft 31*a* relative to the link member 4.

Figure 7:
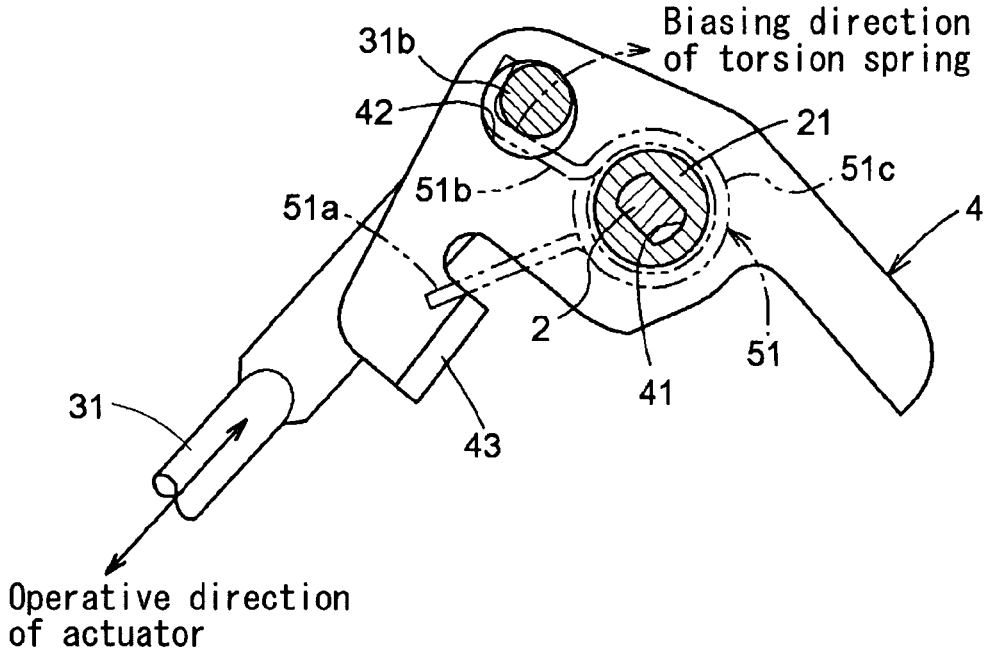
FIG. 7 is a view illustrating a connecting portion between a link member and an actuator rod.

As illustrated in FIGS. 3, 5A, 5B, and 7, the torsion spring 51 includes linear portions 51*a*, 51*b*, and a coil-shaped portion 51*c*. The torsion spring 51 is constituted so that the linear portions 51*a* and 51*b* are biased in a direction to be separated from each other. The torsion spring 51 is disposed between the link member 4 and the actuator rod 31. Precisely, as illustrated in FIGS. 3 and 6, the coil portion 51*c* of the torsion spring 51 is wound via a resin-made bush 21, for example, on the projecting portion of the shaft body 2 relative to the link member 4. Further, the linear portion 51*a* engages with the engagement portion 43 of the link member 4 while the linear portion 51*b* engages with the bush 31*b* provided at the pivot shaft 31*a*. Therefore, the link member 4 and the actuator rod 31 are biased in a direction to contact each other. According to the present embodiment, an inner peripheral portion of the bore 42 of the link member 4 and an outer peripheral portion of the pivot shaft 31*a* provided at the actuator rod 31 are biased in a direction to contact each other. As illustrated in FIG. 7, such biasing direction is defined in substantially parallel with the operative direction of the actuator rod 31. Precisely, the biasing direction is defined to be substantially equal to the protruding direction of the actuator rod 31.

Accordingly, since the torsion spring 51 is disposed between the link member 4 and the actuator rod 31 which moves in substantially the same direction as the link member 4, the link member 4 and the actuator rod 31 are prevented from overcoming the biasing force of the torsion spring 51 when moving. As a result, the valve operating mechanism with the desired responsiveness can be obtained without providing a large-sized actuator 3. Further, looseness between the pivot shaft 31*a* and the bore 42 of the link member 4 is mainly generated along the operative direction of the actuator rod 31. Then, as illustrated in FIG. 7, the biasing direction of the torsion spring 51 can be specified close to the operative direction of the actuator rod 31, precisely, substantially equal to the protruding direction of the actuator rod 31, to thereby increase the biasing force in a direction where looseness is generated. The looseness can be further effectively prevented accordingly. Furthermore, the torsion spring 51 engages with the pivot shaft 31*a* of the actuator rod 31 via the bush 31*b*. Thus, the pivot shaft 31*a* can be prevented from abrasion caused by a sliding of the torsion spring 51.

As illustrated in FIG. 3, the first wall portion 61 of the bracket 6 extends close to the link member 4. Then, as illustrated in FIG. 5A, one face of that extending portion of the first wall portion 61 functions as a first stopper portion 63 for restricting a rotation range of the link member 4 in one direction. In addition, as illustrated in FIG. 5B, a second stopper portion 64 is provided at an opposite side of the first wall portion 61, where the first stopper portion 63 is not provided, for restricting the rotation range of the link member 4 in the other direction. The second stopper portion 64 is constituted by a bolt 64*b* where the link member 4 makes contact with and meshing with a female screw portion formed at the first wall portion 61, and a locknut 64*a* meshing with the bolt 64*b*. The limit of the rotation range of the link member 4 is adjustable by rotatably adjusting an end portion of the bolt 64*b*.

An operation of the valve operating mechanism will be explained below. In the cases where no negative pressure is applied to the negative pressure chamber of the actuator 3 as illustrated in FIG. 5A, the actuator rod 31 is biased in the protruding direction. Thus, the link member 4 is stopped in a state to be in contact with the first stopper portion 63. At this time, the variable intake valve 10 is in an open state (as illustrated by a solid line in FIG. 4).

On the other hand, in the cases where the negative pressure is applied to the negative pressure chamber of the actuator 3 as illustrated in FIG. 5B, the actuator rod 31 is inserted into the actuator main body 32. In association with this returning operation of the actuator rod 31, the link member 4 rotates to thereby rotate the shaft body 2, which leads to the variable intake valves 10 to rotate in the closed direction. Accordingly, the variable intake valves 10 turn to the closed state while the link member 4 is in contact with the second stopper portion 64 (as illustrated by a dashed line in FIG. 4).

As explained above, each variable intake valve 10 can be retained in an appropriate position between the open state and the closed state by the adjustment of the negative pressure applied to the negative pressure chamber of the actuator 3. In this case, a negative pressure means such as a vacuum pump (not shown), for example, for applying the negative pressure to the negative pressure chamber is connected to an engine speed sensor, for example, so that the negative pressure can be applied on the basis of the engine revolutions. Accordingly, an opening degree of the variable intake valve 10 is adjustable on the basis of the engine revolutions.

Figure 8:
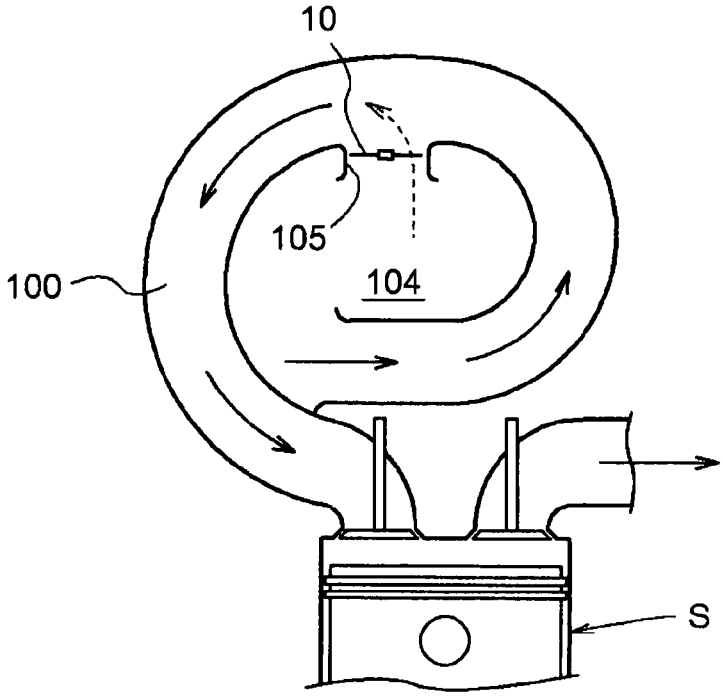
FIG. 8 is a view illustrating another example of the intake air control system in which a valve operating mechanism is employed.

The valve operating mechanism according to the present embodiment can also be used as the variable intake valve 10 for changing or switching an air intake passage to the cylinder S as illustrated in FIG. 8. The intake manifold includes an air distribution chamber 104 for distributing air to the cylinder S. Then, the air intake pipe 100 is provided so as to surround the air distribution chamber 104. One end of the air intake pipe 100 opens to the air distribution chamber 104 while the other end of the air intake pipe 100 is connected to the cylinder S. Further, a second air intake pipe 105 that opens to the air distribution chamber 104 is provided in the middle of the air intake pipe 100. The variable intake valve 10 is provided at the opening of the second air intake pipe 105 so as to open and close the opening.

The variable intake valve 10 improves air intake efficiency by bringing a length of the air intake pipe 100 to vary in response to the engine revolutions. Generally, the air intake pipe 100 is desirably long at the time of low engine revolutions while being desirably short at the time of high engine revolutions. Thus, at the time of low engine revolutions, air is supplied through the air intake pipe 100 from the opening thereof to the cylinder S with the variable intake valve 10 in the closed state as illustrated by a solid arrow in FIG. 8. On the other hand, at the time of high engine revolutions, air is additionally supplied from the opening of the second air intake pipe 105 as illustrated by a dashed arrow in FIG. 8. Accordingly, the long air intake pipe can be assured at the time of low engine revolutions while the short air intake pipe can be obtained at the time of high engine revolutions to thereby efficiently supply air in response to a wide range of engine revolutions.

According to the aforementioned embodiment, the torsion spring 51 biases the link member 4 and the actuator rod 31 to contact each other to thereby prevent looseness at a connecting portion between the link member 4 and the actuator rod 31. In addition, the torsion spring 51 is disposed between the link member 4 and the actuator rod 31 that moves in the substantially same direction as the link member 4, instead of between the link member 4 that is movable and the actuator main body 32 that is fixed as in the conventional valve operating mechanism. Thus, the link member 4 and the actuator rod 31 are prevented from overcoming the biasing force of the torsion spring 51 when moving. As a result, the valve operating mechanism with the excellent responsiveness can be obtained without providing a large-sized actuator 3.

In addition, a biasing direction of the torsion spring 51 is defined in a direction where the actuator rod 31 protrudes from the actuator 3. Looseness at the connecting portion between the link member 4 and the actuator rod 31 is mainly generated along the operative direction of the actuator rod 31. Thus, the biasing direction of the torsion spring 51 can be specified in a direction where the actuator rod 31 protrudes from the actuator 3 to thereby increase the biasing force in a direction where looseness is generated. The looseness can be further effectively prevented accordingly.

Further, the torsion spring 51 is in contact with a portion of the pivot shaft 31*a* projecting from the link member 4 and a resin-made bush 31*b* is provided at the portion with which the torsion spring 51 is in contact.

According to the aforementioned structure, the torsion spring 51 engages with the pivot shaft 31*a* of the actuator rod 31 via the bush 31*b*. Thus, the pivot shaft 31*a* can be prevented from abrasion caused by a sliding of the torsion spring 51.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve operating mechanism comprising:

a valve body provided at an air passage of an internal combustion engine;

an actuator causing the valve body to rotate so as to adjust a cross-sectional area of the air passage;

a shaft body supporting the valve body;

a link member connected to the shaft body and integrally rotating with the valve body;

an actuator rod loosely fitted to the link member and transmitting a driving force of the actuator to the link member; and a biasing member having a first engaging portion and a second engaging portion which are respectively in engagement with the link member and the actuator rod and which establish continual contact between the link member and the actuator rod.

2. A valve operating mechanism according to claim 1, wherein a biasing direction of the biasing member is defined in a direction where the actuator rod protrudes from the actuator.

3. A valve operating mechanism according to claim 1, wherein the actuator rod includes a pivot shaft through which the actuator rod is connected to the link member, and the biasing member is arranged between the pivot shaft and the link member.

4. A valve operating mechanism according to claim 2, wherein the actuator rod includes a pivot shaft through which the actuator rod is connected to the link member, and the biasing member is arranged between the pivot shaft and the link member.

5. A valve operating mechanism according to claim 3, wherein the biasing member is in contact with a portion of the pivot shaft projecting from the link member and a resin-made protection member is provided at the portion with which the biasing member is in contact.

6. A valve operating mechanism according to claim 4, wherein the biasing member is in contact with a portion of the pivot shaft projecting from the link member and a resin-made protection member is provided at the portion with which the biasing member is in contact.

7. A valve operating mechanism according to claim 1, wherein the first engaging portion of the biasing member is one end of the biasing member, while the second engaging portion of the biasing member is the other end of the biasing member.

8. A valve operating mechanism according to claim 7, wherein the actuator rod includes a pivot shaft through which the actuator rod is connected to the link member, and the one end and the other end of the biasing member are engaged with the link member and the pivot shaft, respectively.

9. A valve operating mechanism according to claim 1, wherein the biasing member is a torsion spring.

10. A valve operating mechanism according to claim 1, wherein the actuator rod is loosely fitted to the link member with a clearance or gap maintained therebetween while transmitting the driving force of the actuator to the link member.

* * * * *